United States Patent [19]

Sebesteny

[11] 4,421,311

[45] Dec. 20, 1983

[54] PUZZLE-CUBE

[75] Inventor: Peter Sebesteny, Hamburg, Fed. Rep. of Germany

[73] Assignee: Ideal Toy Corporation, Hollis, N.Y.

[21] Appl. No.: 343,732

[22] Filed: Jan. 29, 1982

[30] Foreign Application Priority Data

Feb. 3, 1981 [DE] Fed. Rep. of Germany ..... 3103583

[51] Int. Cl.[3] ..... A63F 9/08

[52] U.S. Cl. ..... 273/153 S

[58] Field of Search ..... 273/153 S, 155

[56] References Cited

U.S. PATENT DOCUMENTS 3,081,089 3/1963 Gustafson ..... 273/155 X 3,655,201 4/1972 Nichols ..... 273/153 S X

FOREIGN PATENT DOCUMENTS 170062 12/1977 Hungary ..... 273/153 S 55-3956 1/1980 Japan ..... 273/153 S

OTHER PUBLICATIONS

"Notes on Rubik's Magic Cube" by David Singmaster, Published by Enslow Publishers, Hillside, NJ, copyright 1979, p. 29.

*Primary Examiner*—Anton O. Oechsle

*Attorney, Agent, or Firm*—Emrich, Lee, Brown & Hill

[57] ABSTRACT

The present invention relates to a puzzle cube comprising a cube body and the sides of which are formed by cube elements each of them forming part of three cube sections arranged for rotation relative to the remaining portion of the cube body about the center axis of the cube body respectively offset by 90 degrees and a structural support member arranged within the cube body with which the cube elements disposed in the center with respect to the appertaining cube side are cooperating. The remaining cube elements are provided with cams on the inner surface, with the cams engaging behind guide surfaces of the center cube elements, with the cams of the corner cube elements cooperating with the cams and the guide surfaces of the adjacent cube elements.

10 Claims, 15 Drawing Figures

FIG. 1
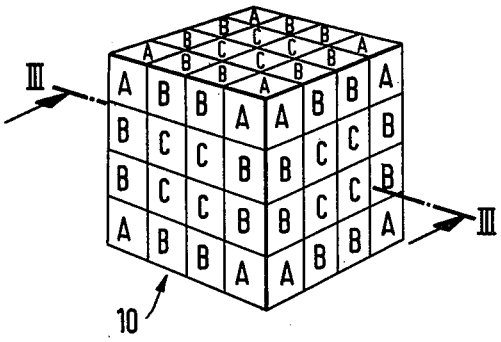
FIG. 2
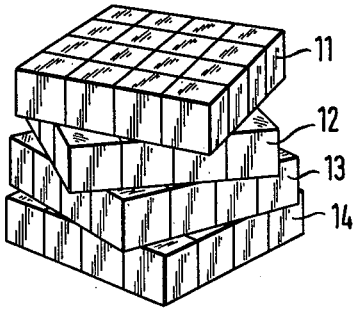
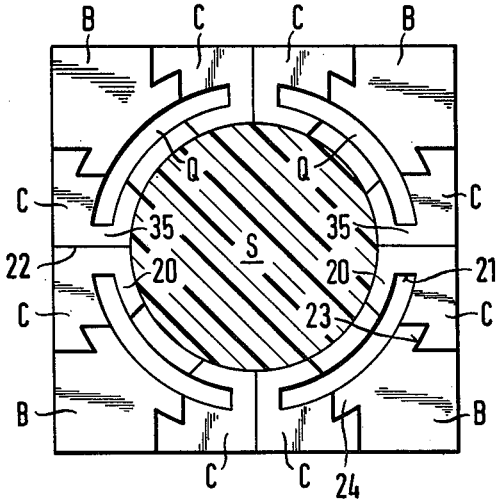
FIG. 3

FIG. 4
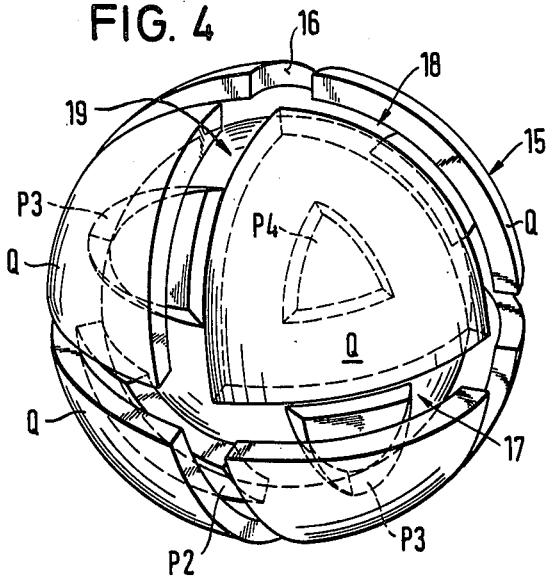
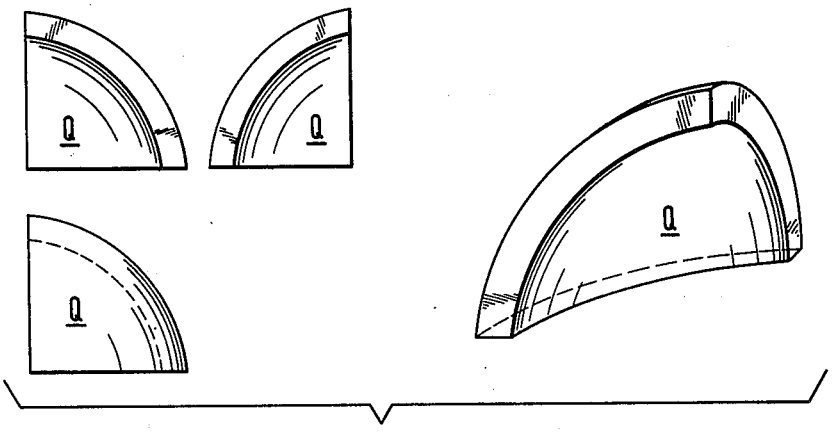
FIG. 5

PUZZLE-CUBE

BACKGROUND OF THE INVENTION

The present invention relates to a puzzle cube which provides for a 4×4×4 arrangement of the cube elements.

A puzzle cube in a 3×3×3 version has been discussed and previously known (The Mathematical Intelligencer, September 1979, pages 29 and 30, Springer-Verlag). In such a puzzle cube, nine outer surfaces of the cube elements are respectively provided with one and the same color, so that in the starting position each side of the cube body is one color. Thus, the cube body has six different colored surfaces which are to be readjusted again after a random disarrangement of the individual cube elements. Each cube element may be rotated about three axes standing perpendicularly one upon another and extending through the cube center. In this rotary movement, it takes along with it all the cube elements that are disposed in the same plane with respect to the direction of rotation. Thus, each cube element forms part of three sections respectively arranged normal to each other and adapted to be rotated about a center axis of the cube. Therefore, each cube element can be rotated only together with the respectively associated section, while by itself it has to be considered as being stationary with respect to the cube body. Precluded is furthermore a diagonal rotation of the cube elements.

SUMMARY OF THE INVENTION

It is the object of the present invention to provide a puzzle cube which, with the possibilities of arrangement being the same as with the known cube, provides for a 4×4×4 arrangement of the cube elements.

This object of the present invention is achieved by the use of a structural support member comprising an inner core, preferably a spherical core, having eight spherical guiding elements arranged thereon in an equally spaced arrangement, with said guiding elements being connected to the core via a web and forming guiding channels extending concentrically in three diameter planes arranged perpendicularly upon each other. The four aligned cube elements include cams thereon which engage the guiding elements and each side of the puzzle cube is comprised of 16 similar type cube elements, with the cams thereon being guided along a circular path, as defined by the guiding elements and with the cams of the cube elements adjacent the center cube elements engaging behind undercut guide surfaces of the center cube elements to define a circular path. Blocking means is associated with one half of the structural support member in such a manner that the cube elements associated with this half are capable of being rotated relative to the remaining cube elements in common with the structural support member only.

In accordance with the present invention, three different cube elements or portions are provided, for each side of the puzzle cube. On each side of the puzzle cube, the four center cube elements are displaceable with respect to the structural support member, in order to permit an adjustment of all the sections of the cube body. For this purpose, the center cube elements are provided with cams which are guided by correspondingly shaped guide surfaces of the structural support member in such a manner that a rotation about the three center axes standing perpendicularly one upon another may occur.

The corner cube elements and the remaining or intermediate cube elements positioned between the corner cube elements cooperate with respect to one another and with the center cube elements, respectively, in such a manner that the cube body composed of the individual cube elements is maintained together. In this instance, the guide surfaces of the cube elements in engagement with each other provide that the desired possibility of rotation is obtained. A guiding engagement with the structural support member is not absolutely necessary; however, it is advantageous for guiding reasons and in the interest of an improved stability of the puzzle.

The blocking means contemplated in the present invention may include many forms. However, it is only necessary in case of a relative rotation of two sections against each other to couple one of the two sections non-rotatably with the support structural member.

Thus, the possibilities of combination of 4×4×4 cube elements arranged at random in an irregular distribution are many times greater than with the conventional puzzle cube consisting of 3×3×3.

Also, in one embodiment of the present invention, provision is made for the blocking means to be formed by portions of the webs projecting into the guiding paths. The webs are preferably formed integrally with the core of the structural support member which, advantageously, is preferably spherically shaped.

According to another embodiment of the present invention, provision is made for the spherical guiding elements to be defined by two parallel equilateral spherical triangles concentric with respect to the center, with the remaining sides of the guide elements forming the radially outwardly disposed wall portion of the associated guiding channel. In this manner, approximately through-going guiding channels are formed which are interrupted only at those locations in which they are intersected by the respective other channels.

It is theoretically possible to form the guiding elements integrally with the core of the support structural member. However, it is within the scope of the present invention to provide the spherical guiding elements as separately shaped members which are adapted to be connected by a web portion to the core. This embodiment is particularly advantageous for the mounting of the individual cube elements to make up the finished cube body.

In accordance with another embodiment of the present invention, provision is made for the sides of the center cube elements that face adjacent center cube elements to be disposed in diameter planes of the core. The cams of the center cube elements are preferaby likewise formed spherically and connected to the center cube element via a web portion. In such an instance, provision is made for the center cube elements to be shaped bipartite in order to facilitate the mounting together, with an inner portion of the cube elements being formed with the web portion and the cam and the two parts being adapted to be connected to each other. Also, the connection may be effected by adhesion, or by a snap type connection, which may be provided if the individual parts are formed of plastic material.

Other and further objects of the present invention will be apparent from the accompanying drawings which, by way of illustration, show a preferred embodiment of the present invention and the principles thereof and what are now considered to be the best mode in which I have contemplated in applying these principles. Other embodiments of the invention embodying the same or equivalent principles may be used and structural changes may be made as desired by those skilled in the art without departing from the scope of the present invention.

DESCRIPTION OF THE DRAWINGS

FIG. 1 shows a perspective representation of the puzzle cube in accordance with the present invention;

FIG. 2 shows a rotation of individual cube elements of the puzzle cube in accordance with the present invention;

FIG. 3 shows a sectional view of the puzzle cube according to one taken on line III—III in FIG. 1;

FIG. 4 shows a perspective view of the structural support member of the puzzle cube in accordance with the present invention;

FIG. 5 shows different perspective views of the guiding element of the structural support member in accordance with the present invention;

DETAILED DESCRIPTION OF THE INVENTION

Figure 6:
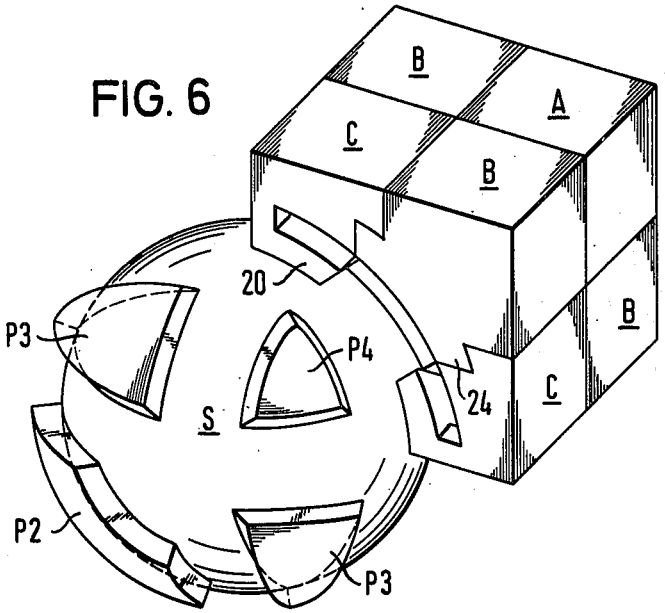
FIG. 6 shows the mounting condition of a corner portion of the cube body at the supporting member.

Prior to describing in detail the individual components depicted in the drawings, it is pointed out that each of the features described and shown is of inventively essential significance by itself or in connection with features of the attached claims. It is emphasized in particular that, because of the geometrically complicated construction of the puzzle cube according to the present invention, the drawings are allotted a particular role in the disclosure of the present invention.

In FIG. 1, a cube body 10 will be shown having six sides, with each side formed by 4×4 cube elements. The cube body 10 is comprised of three different cube elements A, B and C, of which A constitutes the corner cube elements, C the center cube elements, and B the intemediate cube elements positioned between the corner cube elements. Each of the cube elements A, B and C are adapted to be rotated about a center axis of the cube in common with the cube elements disposed in one plane. Thus, each cube element belongs to three different cube sections, the cube sections being respectively rotatable about axes arranged perpendicularly with respect to each other. One possibility of rotation is represented in FIG. 2 where the four horizontal sections 11, 12, 13 and 14 are respectively rotated with respect to each other about a vertical axis of the cube. A similar possibility of rotation results about the two axes disposed orthogonally in the horizontal axis. The possibilities of rotation of the individual cube elements results from the construction thereof and the construction of a structural support member, respectively, as to be seen in more detail from FIGS. 4, 5, 6 and 12 to 15.

The assembled condition of the structural support member in FIG. 4 is designated as a whole as 15. The representation according to FIG. 4, however, only serves for purposes of illustration. The construction shown in FIG. 4 cannot be carried out without appertaining cube elements being mounted thereon.

The structural support member 15 includes a spherical core S, preferably composed of a solid plastic material. The solid embodiment, however, has no meaning for the function of the cube, as shown. Eight web members, P1, P2, P3, P4 are altogether formed integrally with the outer surface of the spherical core S or fastened thereon. A total of eight webs is provided, each of them being associated with one eighth of the surface of the spherical core S. The shape or configuration of the web members may be seen from FIGS. 12 through 15, and will still be enlarged in more detail in the following description. In FIGS. 4 and 6 the web members P1 are not shown. Altogether there are provided one of web member P1, and one of web member P4, with the web members P2 and P3 each provided three times. Spherical guide elements Q are connected and attached to the web member (FIGS. 3 and 4), with the guide elements Q being defined by equilateral spherical triangles in spaced arrangement. The eight spherical guide elements Q are designed identically, with the parallel spaced guiding channels 17, 18 and 19 therebetween and arranged in diameter planes of the structural support member 15 and respectively positioned perpendicularly with respect to each other. As will be seen from FIGS. 3 and 4, the guiding elements Q, and the radially outer and the inner surfaces thereof, define spherical guiding surfaces concentric with respect to the outer spherical surface of the core S, which likewise constitutes a guiding surface.

Also, it is pointed out that the top plan view and two lateral views of the guiding element Q are visible on the left-hand side of FIG. 3. From FIG. 3, it is shown also that the center cube elements C are provided with cam elements 20 corresponding in cross section to the cross section of the guiding channel portion between the guiding element Q and the outer spherical surface of the core S. An extension region of the spherical guiding element Q correspondingly projects into a spherical recess 21 (FIG. 3) of the center cube elements C. The cube elements C are even at the abutting sides thereof, as is shown at 22, said plane being disposed in a diameter plane of the spherical core S.

The center cube elements C are provided with incisions 23 (FIG. 3) at the opposite side thereof, so that two diagonally adjacent cube elements C will form a dovetail-shaped undercut for a dovetailed cam element 24 of the remaining cube elements B. It should be pointed out that the cube elements A, B and C respectively, are designed identically so that the description of details in this respect will hold true for all the remaining cube elements.

Figure 8:
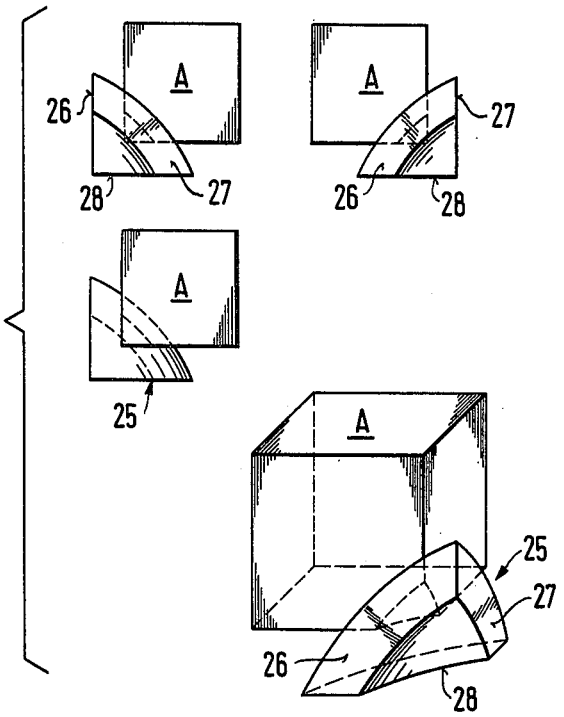
FIG. 8 shows perspectively and in different views, respectively, the corner cube elements of the puzzle cube shown in FIG. 1.

The design of the corner cube element A is best shown in FIG. 8. A spherical member 25 is formed integrally to a corner of the cube element A and acts as a cam element. The spherical member or cam element 25 includes two oppositely disposed spherical triangular surfaces thereon in parallel and uniformly spaced from each other, the rearmost one (in FIG. 8) intersecting the cube A in the corner region. The remaining surfaces of the body 25 being formed by smooth annular surface portions 26, 27 and 28.

Figure 9:
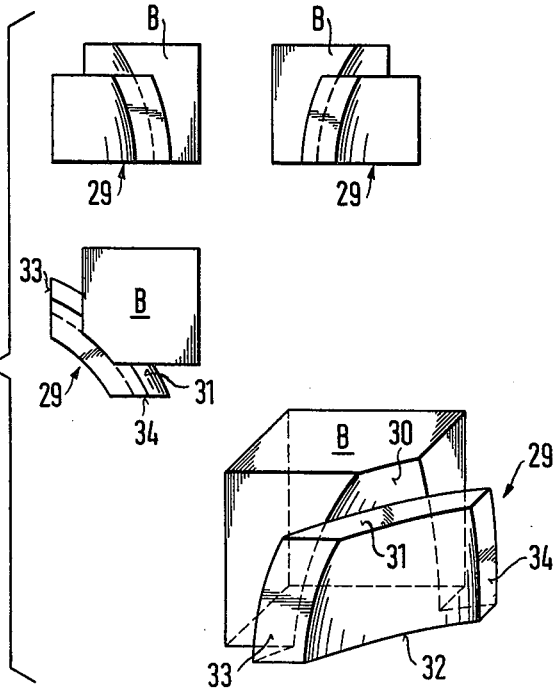
FIG. 9 shows a perspectively in several views the intermediate cube elements of the puzzle cube shown in FIG. 1.

In the same manner, the intermediate cube element B is shown in FIG. 9 having a cam element thereon. The cam element 29 is a spherical trapezoid with a rearward and a forward spherical trapezoidal surface, the rearward surface adjoining a spherical section 30 at one edge of the cube B. The remaining sides of the cam element 29 disposed opposite each other in pairs are smooth annular surface portions 31, 32, 33 and 34. The lower surface 32 of the cam element 29 is disposed in the same plane with the lower surface of cube B, while the upper surface 31 is spaced through a distance from the upper surface of the cube B. This distance corresponds to the distance by which the cam element 25 projects above the underside of the corner cube A, so that the cam element 25 may be mounted with the annular surface 28 fitting upon surface 31 and with the rearward free surface engaging against the surface section 30.

Figure 10:
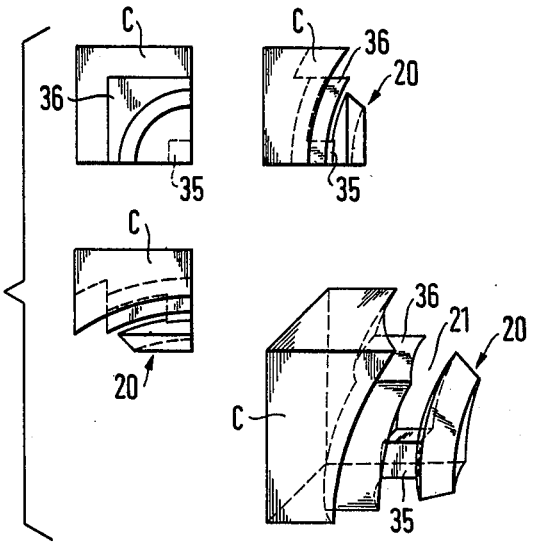
FIG. 10 shows perspectively in several views the center cube elements of the puzzle cube shown in FIG. 1.
Figure 11:
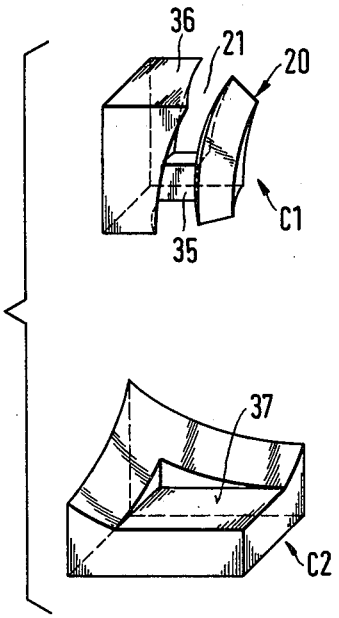
FIG. 11 shows perspectively in several views the center cube elements of the puzzle cube shown in FIG. 1.
Figure 12:
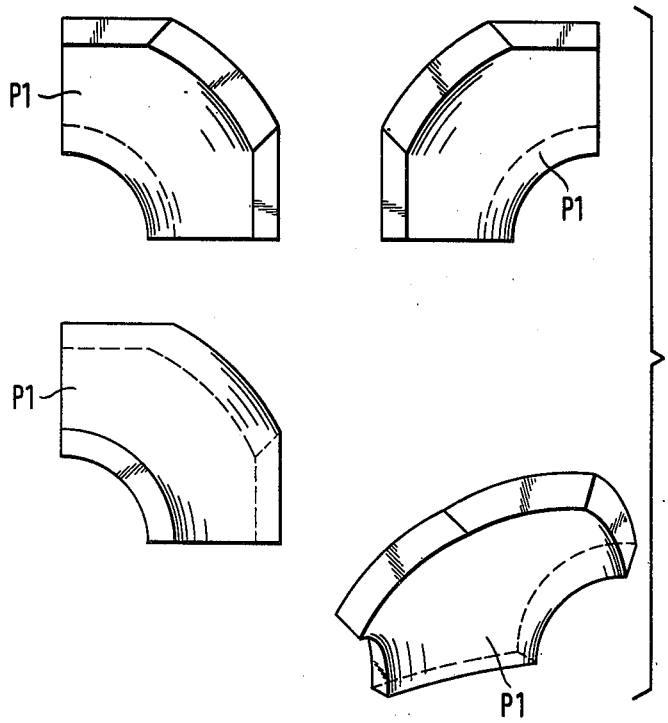
FIG. 12 shows perspectively in several views, respectively, a first web configuration between the core of the structural support member and the guiding element in accordance with FIG. 5.
Figure 13:
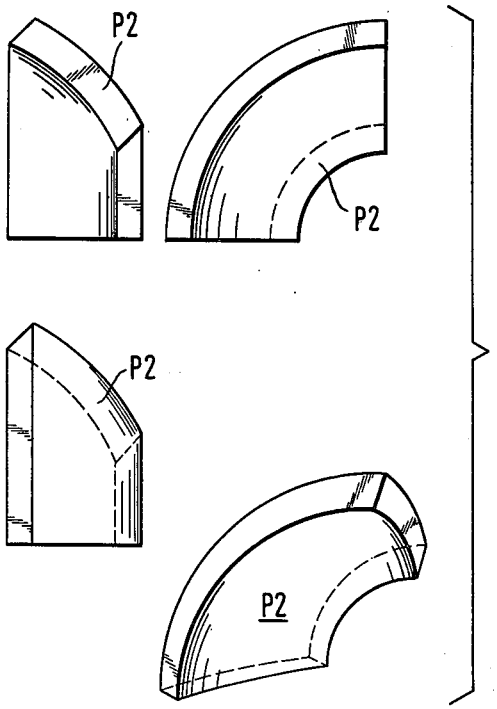
FIG. 13 shows perspectively in several views a second embodiment of the web configuration between the guide element and the core of the structural support member.
Figure 14:
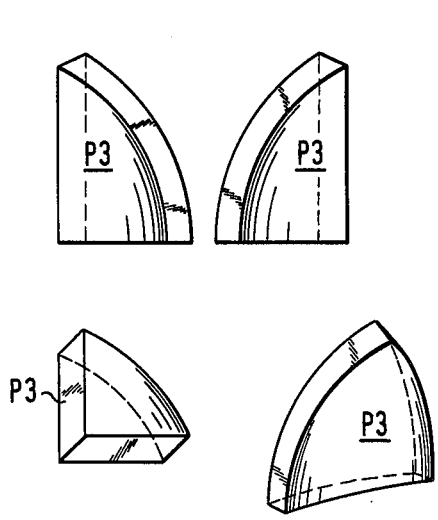
FIG. 14 shows perspectively in several views a third embodiment of a web configuration between the core of the structural support member and the guiding element.
Figure 15:
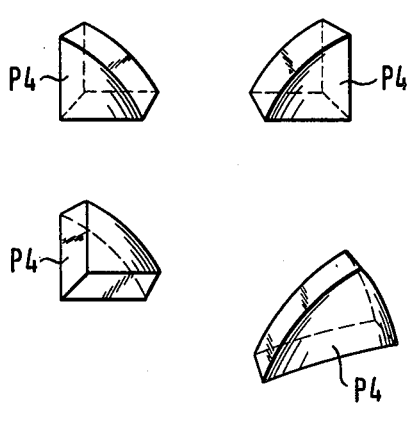
FIG. 15 shows perspectively in several views a fourth embodiment of a web configuration between the core of the structural support member and the guiding element.

The construction of the cube element C and the appertaining cam element 20 thereon is best shown in FIGS. 11 and 12. The shape of the cam element 20, as set forth above, results from the shape of the structural support member, comprising the spherical core S, web members P1 to P4 and spherical guiding elements Q. The cam element 20 is connected to the cube element C via a web 35. For reasons connected with mounting the unit, it is preferred that the cube element C and cam element 20 be formed bipartitely, as is shown in FIG. 11 where the two parts of the unit are referenced C1 and C2. C1 is comprised of a cam element 20, a web 35 and a cube element 36, the square surface thereof disposed opposite to the web 35 and being adapted to be fittingly inserted in a square recess 37 of the cube portion C2. The connection between the elements C1 and C2 being by adhesion, but which may also include the utilization of a snap type connection. Also, it should be pointed out that it is preferred not to enlarge on the individual curved surfaces of the structural member C, as shown in FIG. 10, because the individual surfaces thereof, the distances and radii thereof which results from the cooperation with the remaining parts of the cube, especially from the cube elements B and the support structural member 15, provides the unique fitting of puzzle cube together and avoids play between the various parts and components.

As pointed out above, the web members P1 to P4, as shown in FIGS. 12 through 15, which are connected to the core S on one side and on the other side are respectively connected to one guiding element Q, additionally provide blocking means in order to ensure that the structural support member is non-rotatably coupled always with one half of the cube body when the outer half of the cube body is rotating. The web member P1 which is utilized only once, is designed in such a manner that it blocks all the sides of the appertaining guiding element Q. The blocking means or portions in this operation respectively extend into the respective guiding channel as far as the axial plane of the guiding channel. The web member P4, which likewise is utilized only once, is designed in such a manner that it leaves all the sides of the guiding element Q free. The web members P2, which are utilized three times, blocks two sides of the guiding element and leaves one free. The web members P3, which are utilized three times, blocks one side and leaves two sides free. As regards the web members P1 and P2, the blocking sides thereof lie on those sides of the spherical triangles that are defined by the guiding channels 17 to 18 (FIG. 4). In the case of the web members P3 and P4, the free sides thereof are spaced through a uniform distance from the free sides of the respective spherical triangles and the blocking side of web member P3 again engages the side of the spherical triangle. Although from a mere theoretical standpoint it is not necessary to provide four blocking members per guiding channel 17, 18 and 19, such usage provides a higher stability and a better sliding movement of the individual parts against each other in the completed puzzle assembly.

The assembly of the puzzle cube 10 is explained by reference to FIG. 6. Each spherical guiding element Q is associated with one corner of the finished cube body. When assembling the cube body one begins with a first corner. The remaining seven corners then individually follow thereafter.

Figure 7:
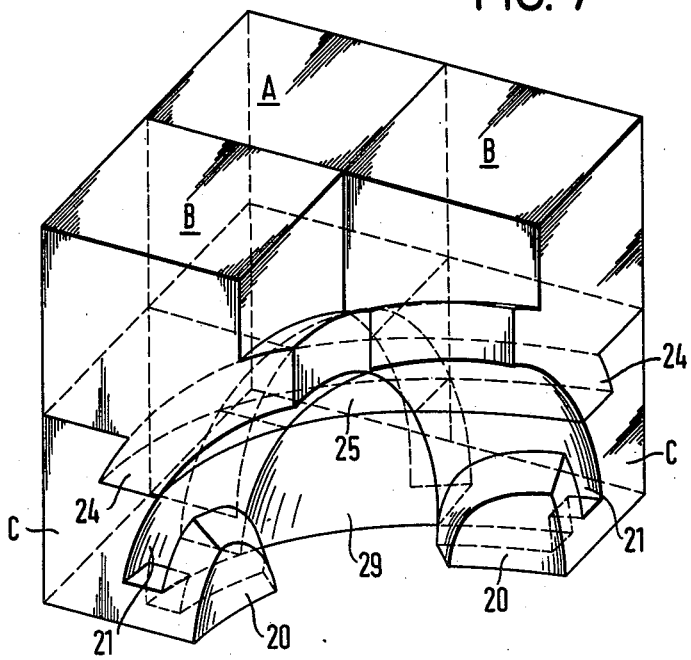
FIG. 7 shows a perspective view of a corner portion of the puzzle cube shown in FIG. 1 without the structural support member.

The assembly takes place as to be described in the following. The appertaining web members P1, P2, P3 and P4, respectively, are fitted on the core S and surrounded by three parts C1 (see FIG. 11) which are assembled with a spherical guiding element Q. Next, the fastening together of the core S, web members P1, P2, P3 and P4, respectively, and guiding elements Q with each other takes place. This fastening may be done by means of a plug-in type connection and/or a snap type connection or through an adhesive connection. Then, a corner cube element A and three remaining cube elements B are fitted as a partial assembly. The latter are then retained in their position by three parts C2 (see FIG. 11), which are connected to the appertaining parts C1. The assembly of the remaining seven corners then takes place in the same manner. In this connection, attention may be drawn also to the structure shown in FIG. 7 from which the assembly of the cube elements of one corner results, with the corresponding portion of the structural support member, however, eliminated for purposes of representation.

As is clear from the above description, all the guiding surfaces of the cube elements A, B and C and at the structural support member are formed in such a manner that they make possible a rotation of the individual cube elements A, B and C about one of the three axes of the cube body standing vertically upon each other. In the embodiment described, all the portions of the cube elements and of the structural support member are formed in such a manner that they engage one another without any gaps therebetween. They are furthermore formed in such a manner that they are all of them solid in themselves; however, it is not necessary for the functioning of the puzzle cube according to the present invention. So, the individual sliding and guiding surfaces, respectively, may be interrupted and, preferably, that the edges of cube elements A, B and C are rounded off to aid in rotation and movement of the puzzle cube parts. Furthermore, the individual parts may be made hollow or partially hollow. What is decisive only is that the described coupling of the individual parts is maintained independently of the relative position with respect to each other, and also the desired possibility of movement thereof is maintained.

I claim:

1. A puzzle cube comprising a cube body, each side of which is composed of 16 cube elements including corner cube elements, intermediate cube elements positioned between the corner cube elements and center cube elements, each of the cube elements having cams thereon and each being adapted for rotation relative to the remaining portion of the cube body about the center axes of the cube body respectively offset by 90 degrees, and a structural support member positioned inside the cube body with which the center cube elements, which with respect to the associated cube sides, cooperate, while the corner and intermediate cube elements are provided with cams at the inner surfaces thereof which engage behind guiding surfaces of the other cube elements, with the cams of the corner cube elements cooperating with cams and guiding surfaces of the adjacent intermediate cube elements, characterized in that the structural support member comprises an inner spherical core having eight spherical guiding elements arranged thereon in uniformly spaced arrangement, said guiding elements being connected to said spherical core by web members and forming concentrically extending guiding channels in three diameter planes extending perpendicularly with respect to each other and in which the cams of the center cube elements with respect to one cube side engage and are guided along a circular path defined by the guiding channels, the cams of the intermediate cube elements adjacent the center cube elements gripping behind undercut guiding surfaces of the center cube elements which define a circular path, and blocking means associated with one half of the structural support member such that the cube elements associated with this half of the support member are capable of being rotated relative to the remaining cube elements attached to the structural support member.

2. A puzzle cube in accordance with claim 1 wherein said blocking means are formed by portions of the web members projecting into the guiding channels defined by said guiding elements.

3. A puzzle cube in accordance with claim 1 wherein said spherical guiding elements are comprised of two parallel, equilateral, and spherical triangles which are concentric with respect to the center of the core, and the remaining sides of the guiding elements form the radially outwardly disposed wall portion of the associated guiding channel.

4. A puzzle cube in accordance with claim 2 wherein said spherical guiding elements are separately shaped portions each of which is adapted to be connected to an associated web member.

5. A puzzle cube in accordance with claim 1 wherein the sides of said center cube elements that face adjacent center cube elements are disposed in diameter planes of the core.

6. A puzzle cube in accordance with claim 1 wherein the cams of said center cube elements are spherically-shaped and are connected to the center cube elements by respective web portions.

7. A puzzle cube in accordance with claim 6, wherein the center cube elements are comprised of an inner portion having a web portion, and said cam thereon, and an outer portion, with said inner and outer portions being connected together.

8. A puzzle cube in accordance with claim 1, wherein said cams of the corner cube elements are formed by two parallel-spaced apart spherical triangles, one of them intersecting and attached to a corner of the cube element, the sides of said triangles having annular surface portions therebetween.

9. A puzzle cube in accordance with claim 1 wherein said cams of the intermediate cube elements are formed as parallel-spaced spherical trapezoids, one side of which intersects and attaches to an edge of the intermediate cube element, one side surface of the cam being disposed in the same plane as an adjacent cube surface, while the opposite side surface thereof of the cam in parallel therewith is inwardly spaced from the opposite cube surface and the two other opposite side surfaces of the cam element have annular surface portions which are positioned in parallel with and spaced from respective sides of the intermediate cube elements.

10. A puzzle cube in accordance with claim 1 wherein the edges of the cube elements are rounded off to provide easy movement of said cube elements with respect to adjacent cube elements.

* * * * *

UNITED STATES PATENT AND TRADEMARK OFFICE

CERTIFICATE OF CORRECTION

PATENT NO. : 4,421,311

DATED : December 20, 1983

INVENTOR(S) : Peter Sebesteny

It is certified that error appears in the above—identified patent and that said Letters Patent is hereby corrected as shown below:

Column 8, line 5, delete "triangles", insert --triangular sides--.

Signed and Sealed this

*Twenty-eighth* Day of *August 1984*

[SEAL]

*Attest:*

GERALD J. MOSSINGHOFF

*Attesting Officer*

*Commissioner of Patents and Trademarks*